US009903191B2

(12) United States Patent
Marmorshteyn et al.

(10) Patent No.: US 9,903,191 B2
(45) Date of Patent: Feb. 27, 2018

(54) METHOD OF INCREASING PRODUCTIVITY OF OIL AND GAS RECOVERY FROM PREVIOUSLY USED WELLS

(71) Applicants: Leon Marmorshteyn, Foster City, CA (US); Yuri Frankel, Baltimore, MD (US); Eugenia Kesler, Foster City, CA (US)

(72) Inventors: Leon Marmorshteyn, Foster City, CA (US); Yuri Frankel, Baltimore, MD (US); Eugenia Kesler, Foster City, CA (US)

( * ) Notice: Subject to any disclaimer, the term of this patent is extended or adjusted under 35 U.S.C. 154(b) by 0 days.

(21) Appl. No.: 15/208,238

(22) Filed: Jul. 12, 2016

(65) Prior Publication Data

US 2018/0016884 A1 Jan. 18, 2018

(51) Int. Cl.

| | |
|---|---|
| ***E21B 43/26*** | (2006.01) |
| ***E21B 43/11*** | (2006.01) |
| ***E21B 33/138*** | (2006.01) |
| *E21B 43/112* | (2006.01) |
| *E21B 43/114* | (2006.01) |

(52) U.S. Cl.

CPC ..... *E21B 43/26* (2013.01); *E21B 43/11* (2013.01); *E21B 33/138* (2013.01); *E21B 43/112* (2013.01); *E21B 43/114* (2013.01)

(58) Field of Classification Search

CPC ..... E21B 43/112; E21B 43/114; E21B 33/138
See application file for complete search history.

(56) References Cited

U.S. PATENT DOCUMENTS

| | | | | |
|---|---|---|---|---|
| 3,409,096 | A * | 11/1968 | Brown | E21B 33/134 166/130 |
| 4,662,448 | A * | 5/1987 | Ashford | C09K 8/5045 166/290 |
| 2003/0070805 | A1* | 4/2003 | Bassin | C09K 8/72 166/250.02 |
| 2010/0044047 | A1* | 2/2010 | Kabishcher | E21B 43/003 166/308.1 |
| 2010/0314170 | A1* | 12/2010 | Yerusalimsky | E21B 43/119 175/57 |
| 2010/0314171 | A1* | 12/2010 | Yerusalimsky | E21B 43/119 175/57 |
| 2014/0083674 | A1* | 3/2014 | Pasvandi | E21B 43/112 166/55.2 |
| 2016/0168969 | A1* | 6/2016 | Marmorshteyn | E21B 43/26 166/297 |
| 2016/0319628 | A1* | 11/2016 | Schultz | E21B 33/138 |

OTHER PUBLICATIONS

Dictionary definition of "slot", accessed Jun. 10, 2017 via www.merriam-webster.com.*
Schlumberger Oilfield Glossary entry for "water flood", accessed Jun. 10, 2017 via www.glossary.oilfield.slb.com.*

* cited by examiner

*Primary Examiner* — Blake E Michener
(74) *Attorney, Agent, or Firm* — Henry M. Feiereisen LLC

(57) ABSTRACT

Oil and gas recovery includes selecting a previously used oil or gas containing layer in which cumulative perforation was utilized, closing micro cracks over a thickness of the oil or gas containing layer, carrying out slotting of the oil or gas containing layer to form slots, producing micro cracks over the thickness of the oil or gas containing layer, carrying out hydraulic fracturing of the oil or gas containing layer, and withdrawing oil or gas from the oil or gas containing layer with maintaining of a pressure in the well.

4 Claims, No Drawings

METHOD OF INCREASING PRODUCTIVITY OF OIL AND GAS RECOVERY FROM PREVIOUSLY USED WELLS

BACKGROUND OF THE INVENTION

The present invention relates to oil and gas excavation, and in particular it relates to methods for oil and gas recovery from oil and gas containing layers in previously used wells.

It has been determined that main recovery of oil and gas from communicating pores in rock constitutes not more than 25%. It is determined by the presence of a normal layer pressure, a degree of water accumulation, and other causes. In complex collectors the number of communicating pores does not exceed 20%. The main quantity of oil and gas is contained in closed pores. However oil and gas actually are not recovered from them. Also with a drop in layer pressure and water inflow a well actually stops delivery of oil and gas The known currently used method of opening, for example a cumulative perforation, can serve as an indicator of the presence of oil or gas, but not as a reliable method of opening in such collectors. It has been found that with the use of cumulative perforation, blocking water barriers are created, and thery prevent penetration of oil or gas into a well. This is confirmed by a decrease of productivity more than 6 times with an increases of number of cumulative perforation blasts. In conventional collectors there are 40-60% of such closed pores.

With the use of cumulative perforation microcracks are created along a dimension of a, which during a subsequent hydro-fracturing are increased and connected with water-containing spaces. This in turn leads to water overflow of a productive layer and subsequent stopping of oil or gas recovery It is therefore desirable to use improved methods for recovery from productive layers significantly greater quantities of oil and gas, instead of abandoning the areas of oil and gas recovery after some quantities thereof have been recovered.

SUMMARY OF THE INVENTION

Accordingly, it is an object of the present invention to provide a method of increasing productivity oil and gas recovery from oil and gas containing layers, which is a further improvement of known methods of oil and gas recovery.

In keeping with these objects and with others which will become apparent hereinafter, one feature of the present invention resides, briefly stated, a method of oil and gas recovery from oil and gas containing layers, which comprises the steps of selecting a previously explored and used oil or gas containing layers in which cumulative perforation was utilized, closing micro cracks over a thickness of the oil or gas containing layer which are produced in the oil or gas containing layer as a result of the cumulative perforation, carrying out slotting of the oil or gas containing layer to form corresponding slots in the latter, producing micro cracks over the thickness of the oil or gas containing layer, carrying out hydraulic fracturing of the oil or gas containing layer, and withdrawing oil or gas from the oil or gas containing layer with maintaining of a pressure in a well through which the oil or gas containing layer is reached and oil or gas is recovered.

According to another feature of the present invention the closing micro cracks over a thickness of the oil or gas containing layer produced in the oil or gas containing layer as a result of the cumulative perforation is provided with the use of corresponding closing material containing solutions, such as for example by bentonite clay solution.

According to a further feature of the present invention the slotting of the oil or gas containing layer is carried out by a hydraulic slotting, hydraulic sand blasting with the use of a corresponding hydraulic slotting fluids, or tool cutting.

According to a further feature of the present invention the micro cracks in the oil or gas containing layer can be produced after cutting of slots, by plasma actions, impulse actions, acoustic actions, etc. applied to the oil or gas containing layers.

According to a further feature of the present invention the hydraulic fracturing of the oil or gas containing layer is carried out by pumping a hydro-cracking medium or liquid into the oil or gas containing layer.

According to a further feature of the present invention the maintenance of a pressure in a well through which the oil or gas containing layer is reached and oil or gas is recovered is provided by pumping a liquid under pressure in a neighboring well to increase a layer pressure onto the same oil or gas containing layer.

According to a further feature of the present invention, the recovery of oil or gas from the oil or gas containing layer is then carried out with maintaining of the above specified increased pressure.

According to a further feature of the present invention after the slotting of the oil or gas containing layer, a secondary slotting is carried out perpendicular to a direction of cracks to produce additional perpendicular slots.

The novel features of the present invention are set forth in particular in the appended claims.

The invention itself will be best understood from the following detailed description of the invention.

DESCRIPTION OF THE PREFERRED EMBODIMENTS

In a method of oil and gas recovery from oil and gas containing layers in previously used wells according to the present invention a well with a previously explored and used oil or gas containing layer is selected. Usually it is a well in which cumulative perforation was utilized to recover oil or gas from oil or gas containing layers.

During the cumulative perforation of oil or gas containing layer, micro cracks are produced within the height of the layer, which during a subsequent hydraulic fracturing absorb water which then prevents a subsequent inflow of oil or gas. In order to avoid this undesirable effect, according to the present invention micro cracks over a thickness of the oil or gas containing layer produced in the oil or gas containing layer as a result of the cumulative perforation are closed. The closing of the cracks is carried out with the use of corresponding closing material containing solutions, such as for example by bentonite clay solution.

In a subsequent step, slotting of the oil or gas containing layer is carried out, which results in a slotting pressure relief, substantially excluding influence of a rock pressure. Slot-shaped cavities which are produced by the slotting completely remove annular compressive stresses which prevents movement of oil or gas to be recovered, thereby increasing the inflow of oil or gas. It is desirable to produce 4 slots with a width which is not less than 2 diameters of the well, extending along the whole height of the oil or gas containing layer but not less than 10 diameters of the well, and having a thickness not less than 3 cm. The slotting can be carried out by hydraulic sand-blasting, or disc-shaped tools. As a result, an asymmetric stress field is created, which results in intense pressure relief of the layer, opening of the pores, and increase of filtration coefficient in a direction which is perpendicular to the plane of the slots. In order to exclude influence of deep horizontal stresses, slots can be also used, which are oriented perpendicular to the direction of horizontal stresses.

It is also possible to produce additionally secondary slots within the interval of the first slots and perpendicular to the direction of cracks. For example, 2 secondary slots can be produced by the same method and/or equipment as the first mentioned slots.

After the opening of the layer by the slotting, an additional cracks formation is produced to involve a great number of pores into the oil or gas recovery processes. The cracks can be formed by methods which create a high pressure in rocks, on the order of several thousands of atmospheres in the corresponding area. For this purpose various actions can be utilized, such as action by plasma, action by pulsations, actions by acoustic waves, etc. Their magnitude is selected to create high pressures for generating a plurality of cracks.

In a next process of the method according to the present invention hydraulic fracturing of the oil or gas containing layer is carried out. This can be achieved for example by a hydraulic action, including pumping of liquid under high pressure. It is possible for this purpose to pump liquids which contain sand and/or other particles, to provide cutting by rotating tools, etc. As a result of this, existing cracks are opened and new cracks are formed. During subsequent additional pumping-in of a mixture of liquid and sand, the cracks are expanded or wedged out with maintaining of a high ability for passage of oil or gas and removal of the excessive pressure after finishing the process and removing the excessive pressure.

Since the recovery is carried out in layers which were explored before, a layer pressure in them is significantly reduced and therefore productivity of the wells is reduced as well, while they still contain significant quantities of oil or gas. In order to maintain or increase the pressure in the well, additional pumping of wells are used. Through these additional wells a liquid is pumped into the same layer under pressure. As a result, a layer pressure in the layer, from which oil or gas are to be recovered, is maintained on certain lever and can be increased.

The subsequent process of direct recovery of oil or gas from the layer through the well in accordance with the present invention is carried out with the presence of the sufficient pressure.

The present invention is not limited to the details which are explained hereinabove, since various modifications and structural changes are possible without departing from the spirit of the invention.

What is desired to be protected by Letters Patent is set forth in the appended claims.

The invention claimed is:

1. A method of oil and gas recovery from oil and gas containing layers, comprising the steps of selecting a previously explored and used oil or gas containing layer in which cumulative perforation was utilized;

closing micro cracks over a thickness of the oil or gas containing layer produced in the oil or gas containing layer as a result of the cumulative perforation with the use of bentonite clay solution;

carrying out slotting of the oil or gas containing layer by disc-shaped tools to form corresponding slots in the latter, including 4 slots with a width of 2-10 diameters of the well along a whole height of the oil or gas containing layer;

producing micro cracks over the thickness of the oil or gas containing layer, wherein the micro cracks produced over the thickness of the oil or gas containing layer are produced after cutting of slots by actions selected from the group consisting of plasma actions, impulse actions, acoustic actions, applied to the oil or gas containing layers;

carrying out hydraulic fracturing of the oil or gas containing layer by a corresponding action; and withdrawing oil or gas from the oil or gas containing layer with maintaining of a pressure in a well through which the oil or gas containing layer is reached and oil or gas is recovered.

2. The method of claim 1, wherein a maintenance of a pressure in a well through which the oil or gas containing layer is reached and oil or gas is recovered is provided by pumping a liquid under pressure in a neighboring well to increase a layer pressure onto the same oil or gas containing layer.

3. The method of claim 2, wherein a withdrawing oil or gas from the oil or gas containing layer to recover oil or gas is then carried out with maintaining of the increased pressure.

4. The method of claim 1, further comprising carrying out a secondary slotting of the oil and gas containing layer to form corresponding slots in the latter, which are substantially perpendicular to the slots made during the slotting.

* * * * *